US006360398B1

(12) United States Patent
Wiegner et al.

(10) Patent No.: US 6,360,398 B1
(45) Date of Patent: Mar. 26, 2002

(54) TOOTHBRUSH HAVING AN EXCHANGEABLE BRISTLE PLATE

(75) Inventors: Georg Wiegner, Flat E, 14th Floor, Hilton Tower, 96 Granville Road, Tsimshatsui; Hyeong Sook Kim, both of Kowtoon (HK)

(73) Assignee: Georg Wiegner (CN)

( * ) Notice: Subject to any disclaimer, the term of this patent is extended or adjusted under 35 U.S.C. 154(b) by 0 days.

(21) Appl. No.: 09/492,507

(22) Filed: Jan. 27, 2000

(30) Foreign Application Priority Data

Jan. 29, 1999 (DE) ..... 199 03 505

(51) Int. Cl.[7] ..... A46B 7/04; A46B 9/04
(52) U.S. Cl. ..... 15/167.1; 15/176.1; 15/176.4
(58) Field of Search ..... 15/167.1, 176.1, 15/176.4–176.6

(56) References Cited

U.S. PATENT DOCUMENTS

| | | | | | |
|---|---|---|---|---|---|
| 1,717,125 | A | * | 6/1929 | Spitz | 15/176.4 |
| 1,875,476 | A | * | 9/1932 | McNally | 15/176.4 |
| 1,939,001 | A | * | 12/1933 | Doll | 15/176.1 |
| 5,864,915 | A | | 2/1999 | Ra | 15/167.1 |
| 5,967,152 | A | | 10/1999 | Rimkus | 132/308 |

FOREIGN PATENT DOCUMENTS

| | | | | |
|---|---|---|---|---|
| DE | 2121872 | * | 2/1972 | 15/176.6 |
| DE | 3038895 | * | 8/1982 | 15/176.4 |
| DE | 8525867.9 | | 8/1986 | |
| DE | 9109625.1 | | 10/1991 | |
| DE | 9309004.8 | | 9/1993 | |
| DE | 29816089 | | 1/1999 | |
| EP | 0285121 | | 10/1988 | |
| GB | 1265503 | | 3/1972 | |
| JP | 6-304020 | * | 11/1994 | 15/167.1 |
| JP | 6-304021 | | 11/1994 | |

* cited by examiner

*Primary Examiner*—Mark Spisich
(74) *Attorney, Agent, or Firm*—Steven F. Caserza; Flehr Hohbach Test Albritton & Herbert LLP

(57) ABSTRACT

Toothbrush having an exchangeable bristle plate which is fastened releasably on a head-side carrier plate of a toothbrush body by a groove/tongue anchorage in conjunction with a press fit of a handle-side end of the bristle plate on an undercut stop of the toothbrush body. The undercut of the stop of the toothbrush body is designed in the form of a round wedge, a round wedge of the bristle plate finally engaging in the undercut when a central, rear elongate tongue is anchored in the groove of the carrier plate. The toothbrush body can be bent, at least in the region of the carrier plate and of a toothbrush neck, in order for the round-wedge securing arrangement of the bristle plate to be levered out.

4 Claims, 1 Drawing Sheet

TOOTHBRUSH HAVING AN EXCHANGEABLE BRISTLE PLATE

Figure 4:
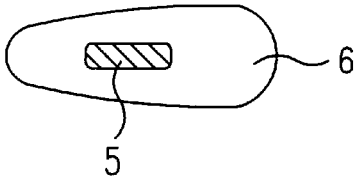

The invention relates to a toothbrush having an exchangeable bristle plate.

Toothbrushes having an exchangeable bristle section are suitable in view of the growing awareness of hygiene and environmental matters. Every year vast quantities of toothbrushes are used up, and the numbers are increasing, it being the intention for the user to change the toothbrush every 2 to 3 months. This is necessary from the point of view of hygiene, It is not necessary, however, to throw away the entire toothbrush.

Help is provided here by the so-called exchangeable-head toothbrushes, in which it is only the bristle head which is replaced, the brush handle being retained. Such a toothbrush is known from G 85 25 867.9, in which a handle part is connected releasably to a brush part of predetermined length in order that the entire bristle region is supported over the entire surface area by a connector region of the handle part. For a press fit with just one groove/tongue connection in the form of a pin extension, provision is made for an extension on the handle part to be undercut and of angled design, with the result that the bristle part is secured in a positively locking manner, by way of an appropriately shaped end, against lateral displacement and lifting. In order to release the connection, a slot-like recess is made in the end side, and a tool can be introduced therein.

It has proven disadvantageous, however, that the design involves excessive outlay in order for the bristle section to be fastened securely, with the result that, in order to release the connection, additional tools are necessary or it is necessary to provide dedicated design elements in order to release the connection.

DE 44 34 617 A1 discloses a toothbrush having an exchangeable bristle insert which is received with latching action in an elongate retaining cutout of a head part. Latching strips on the circumferential surface of the bristle insert engage in latching grooves of the head part. The bristle insert tapers, in plan view, from one end to its other end and has smooth, uninterrupted sections of its circumferential surface butting flat against smooth, uninterrupted sections of the inner wall, this resulting in a wedge or clamping action of the bristle insert in the longitudinal direction. In the case of this previously known toothbrush, during the exchanging operation, the bristle plate is pressed out of the latching connection by virtue of pressure being applied to a push knob. The action of releasing such a latching connection is generally laborious and is thus disadvantageous in handling terms.

The object of the invention is thus to provide a toothbrush which hat an exchangeable bristle plate and allows, on the one hand, secure fastening of the bristle plate on a toothbrush body and, on the other hand, straightforward exchange of the bristle plate.

This object is achieved by the features of claim 1.

This provides a toothbrush which has an exchangeable bristle plate and allows the bristle plate to be anchored such that it is secured against offset positioning on the carrier plate of an otherwise unchanged toothbrush and, in the process, is very straightforward to handle and to release. It is only a small proportion of the overall material of the toothbrush which is exchanged. The round-wedge-form undercut, in which the round wedge of the bristle plate finally engages, precludes any possibility of offset positioning in the upward direction. It is not possible either for the bristle plate to be pushed out upward by virtue of pressure being applied on the central locking arrangement. In conjunction with the elongate central locking arrangement, any capacity for lateral displacement is prevented, with the result that the bristle plate is anchored firmly in captive fashion. The decisive factor, however, is that said fixed anchoring arrangement can easily be released by bending, as a result of which the undercut opens.

It has proven advantageous in this respect if the undercut decreases in size in each case in the outward direction from the inside in order, during the bending operation, to aid the release of the engagement of the shape-adapted end of the bristle plate.

The material used for the toothbrush body is preferably plastic, such as polypropylene (PP), polyethylene terephthalate (PET) or polyethylene terephthalate which is suitable for injection molding (PETG). This material is sufficiently flexible, which is advantageous for the exchange function and for the use of the toothbrush.

Further configurations of the invention can be gathered from the following description and the subclaims.

Figure 5:
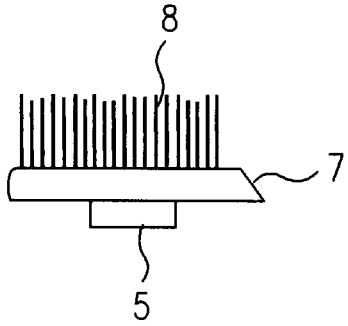
Figure 3:
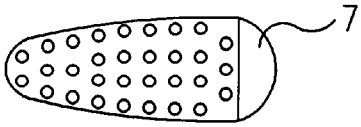
Figure 2:
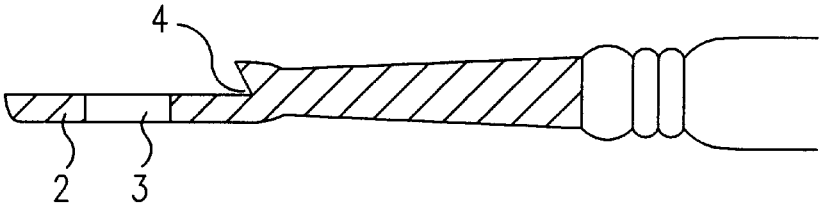
Figure 1:
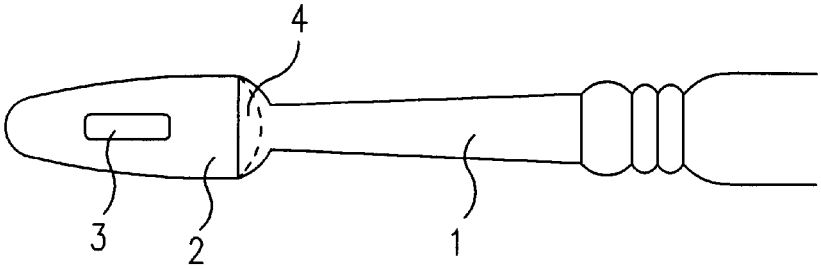

The invention is explained in more detail hereinbelow with reference to the exemplary embodiment illustrated in the attached figures, in which:

FIG. 1 shows, schematically, a plan view of a head-side portion of a toothbrush with a carrier plate, FIG. 2 shows, schematically, a longitudinal section of the portion of the toothbrush according to FIG. 1, FIG. 3 shows, schematically, a plan view of an exchangeable bristle plate, FIG. 4 shows, schematically, a bottom view of the bristle plate according to FIG. 3, FIG. 5 shows, schematically, a side view of the bristle plate according to FIG. 3.

FIGS. 1 and 2 show a head-side portion of a toothbrush with a toothbrush neck 1 of a toothbrush body, with is adjoined on the head side by a carrier plate 2. The carrier plate 2 is preferably connected integrally to the toothbrush neck 1.

The carrier plate 2 has the outer contours of a toothbrush head of selectable dimensions. An elongate opening is formed in the carrier plate 2 and forms a groove 3 for a groove/tongue connection to an exchangeable bristle plate 6. The groove 3 is arranged centrally, i.e. along a center line of the carrier plate 2.

On the toothbrush-neck side, the carrier plate 2 is bounded by an undercut stop 4 of the toothbrush body. This undercut of the stop 4 is designed in the form of a round wedge, the undercut decreasing in size in the outward direction, to the border-side boundary of the carrier plate 2, from the inside.

A bristle plate 6, which is illustrated in FIGS. 3 to 5, can be snap-fitted onto the carrier plate 2. The bristle plate 6 has dimensions which are adapted to the dimensions of the carrier plate 2, in order that the entire bristle plate is supported by the carrier plate 2. This also avoids edges which could be problematic when one is cleaning one's teeth. On its underside, the bristle plate 6 has a projecting elongate tongue 5 (see FIG. 5) which can be inserted into the groove 3 of the carrier plate in a positively locking manner. Furthermore, on its side directed toward the toothbrush neck 1, the bristle plate 6 has an end designed as a round wedge 7. The round wedge is shape-adapted to the round-wedge undercut of the stop 4 for a positively locking press fit of the bristle plate 6 and stop 4 when the bristle plate 6 and carrier plate 2 are anchored via the groove/tongue connection 3, 5.

The bristle plate 6 may thus be positioned with its underside flat on the carrier plate 2. Extending from the top side, located opposite the underside, of the bristle plate 6 is an area of bristles 8 which are anchored in the bristle plate 6 and are thus borne by the same.

The toothbrush body consists of a flexible material at least in the region of the carrier plate 2 and of the toothbrush neck 1. Particularly preferred materials are polypropylene (PP), polyethylene terephthalate (PET) or polyethylene terephthalate which is suitable for injection molding (PETG). The bristle plate 6 itself may be formed by a thin plastic plate.

The operations of fitting and releasing the bristle plate 6 take place in an extremely straightforward manner as follows:

the round wedge 7 is inserted into the mating element, i.e. the undercut of the stop 4, obliquely from above and the bristle plate 6 is pressed down firmly, with the result that the central locking arrangement 3, 5 snaps in. The bristle plate 6 is then anchored firmly in captive fashion.

For release purposes, the toothbrush neck 1 and the carrier plate 2 are bent approximately convexly, as a result of which the wedge-type securing arrangement 4, 7 is levered out and the bristle plate 6 is freed. For bending purposes, it is possible for the fingers of one hand to be held beneath the toothbrush for support approximately level with the toothbrush neck 1 and for the thumb of the other hand to press the tip of the bristle plate 6 in the downward direction.

The exchange head described above may also be used for plug-on toothbrushes of electric toothbrushes.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed is:

1. A toothbrush comprising:

a toothbrush body having an elongated neck extending from a distal end thereof, an elongated planar carrier plate including a first end extending from the distal end of the neck and a second free end, the carrier plate including an elongate central groove defining an aperture extending through the carrier plate;

a round-wedge-form undercut stop located at the meeting of the first end of the carrier plate and the distal end of the neck, said undercut stop including a top wall spaced from an upper surface of the carrier plate and including a concave surface beneath said top wall facing the free second end of the carrier plate, the concave surface extending across the width of the carrier plate and the depth of the undercut stop beneath said top wall decreases from a central portion thereof to each of opposite sides thereof which sides define the width of the carrier plate;

a bristle plate including a bristled upper surface and a lower surface including an elongate tongue adapted for releasable insertion into the groove of the carrier plate, a first end of said bristle plate including a round wedge extending across the width thereof and which defines a convex shape which matches the concave shape of the undercut stop; and whereby the bristle plate and the carrier plate are releasably connected with a snap-fit connection and a second end of the bristle plate is free of direct attachment to said carrier plate.

2. A toothbrush according to claim 1, wherein said toothbrush body comprises a flexible material in the region on the carrier plate and of the toothbrush neck.

3. A toothbrush according to claim 2, wherein the flexible material comprises polypropylene (PP), polyethylene terephthalate (PET) or polyethylene terephthalate which is suitable for injection molding (PETG).

4. A toothbrush according to claim 1, wherein the bristle plate comprises a thin plate in which a cluster of bristles is fastened in a selectably arranged manner.

* * * * *